US006484347B1

(12) United States Patent
Wang

(10) Patent No.: US 6,484,347 B1
(45) Date of Patent: Nov. 26, 2002

(54) STEAM CLEANER

(76) Inventor: Ta-Chin Wang, 17-2 Fl., No. 457, Cheng-Kung Rd., Tainan (TW)

( * ) Notice: Subject to any disclaimer, the term of this patent is extended or adjusted under 35 U.S.C. 154(b) by 0 days.

(21) Appl. No.: 09/899,238

(22) Filed: Jul. 6, 2001

(51) Int. Cl.[7] ..... B08B 3/02
(52) U.S. Cl. ..... 15/320; 15/344
(58) Field of Search ..... 15/320, 344

(56) References Cited

U.S. PATENT DOCUMENTS 1,803,693 A * 5/1931 Cutting ..... 15/320
3,061,959 A * 11/1962 Blumenfeld ..... 15/320
5,386,612 A * 2/1995 Sham ..... 15/320
6,122,367 A * 9/2000 Burr et al. ..... 15/320
6,289,551 B1 * 9/2001 Basile ..... 15/320
6,311,365 B1 * 11/2001 Dornier ..... 15/302

* cited by examiner

*Primary Examiner*—Chris K. Moore
(74) *Attorney, Agent, or Firm*—Jones, Tullar & Cooper, P.C.

(57) ABSTRACT

A steam cleaner has a housing, a steam generator, a pump, a reservoir, a cap and a filter. The steam generator is mounted in the housing. The pump is mounted in the housing and communicates with the steam generator. The reservoir is detachably attached to a base on the housing. The cap is detachably attached to the reservoir and communicates with the steam generator. The filter is detachably attached to the cap and extends into the reservoir. Accordingly, the water in the reservoir is filtered by the filter before the water is transported to the steam generator. The structure of the housing and the mold to form the housing are simplified. The cost for manufacturing the steam cleaner is reduced. Furthermore, to install and to change the filter is easier.

8 Claims, 3 Drawing Sheets

STEAM CLEANER

BACKGROUND OF THE INVENTION

1. Field of the Invention

The present invention relates to a steam cleaner, and more particularly to a steam cleaner with a detachable filter attached to a cap.

2. Description of Related Art

In general, water is always used to clean objects like windows, floors, vehicles and the like. Water does not disinfect the cleaned object unless a disinfectant is added to the water. However, because disinfectant is usually a strong chemical product, the chemical disinfectant easily irritates or injures the skin of the user and pollutes the environment. Therefore, a cleaner that can spray steam to disinfect is provided. With reference to FIG. 3, a conventional steam cleaner in accordance with the prior art comprises a housing (40), a steam generator (42), a pump (44) and a reservoir (50). A discharge opening (not numbered) is defined in one end of the housing (40). A base (not numbered) is on another end of the housing (40). A scrubbing device (not shown) such as a brush or a sponge is attached to the discharge opening in the housing (40). The steam generator (42) is mounted in the housing (40). A nozzle (422) is attached to the steam generator (42) and faces the discharge opening in the housing (40). The pump (44) is mounted in the housing (40) and communicates with the steam generator (42) through a discharge hose (not numbered).

The reservoir (50) has a top and a bottom, contains water and is attached to the base on the housing (40). A fill opening (not numbered) is defined in the top of the reservoir (50), and a cap (52) with an interior bottom and exterior top is attached to the top of the reservoir (50) to close the fill opening in the reservoir (50). A pick-up hose (54) is attached to the bottom of the cap (52) and extends into the reservoir (50). A block (56) with a passage (not shown) is attached to the free end of the pick-up hose (54), such that the free end of the pick-up hose (54) is kept near the bottom of the reservoir (50). A protrusion (522) with an axial through hole (not numbered) is formed on the top of the cap (50), and the axial through hole communicates with the pick-up hose (54). A filter (60) is attached to the housing (40) between the pump (44) and the reservoir (50) to purify the water. The filter (60) has an inlet (62) on one end of the filter (60) and an outlet (64) on the other end. The inlet (62) communicates with the protrusion (522) on the cap (52) through a hose (not shown), and the outlet (64) communicates with the pump (44) through another hose (not shown). Accordingly, the water in the reservoir (50) is transported to the steam generator (42) by the pump (44) through the pick-up hose (54), the cap (52) and the filter (60). The steam generator (42) heats the water, and steam is generated and sprayed from the nozzle (422). When the user uses the scrubbing element to clean an object, the sprayed steam disinfects the object. In addition, because there is a filter (60) arranged between the pump (44) and the reservoir (50), the water will be filtered before the water is transported to the steam generator (42). The accumulation of impurities in the steam generator (42) can be avoided.

However, because the conventional filter (60) is an outer element relative to the reservoir (50) and is attached to the housing (40), the housing (40) must be modified to mount the filter (60). The structure of the housing (40) and the mold for forming the housing (40) are complex. The cost of manufacturing the conventional steam cleaner is expensive.

In addition, to attach the filter (60) to the housing (40) and to change the filter (60) after an appropriate period of use are difficult.

To overcome the shortcomings, the present invention tends to provide an improved steam cleaner to mitigate or obviate the aforementioned problems.

SUMMARY OF THE INVENTION

The main objective of the invention is to provide an improved steam cleaner having a filter mounted in the reservoir. The steam cleaner has a housing, a steam generator, a pump, a reservoir, a cap and a filter. The housing has a base. The steam generator is secured in the housing. The pump is mounted in the housing and communicates with the steam generator. The reservoir is detachably attached to the base on the housing. The cap is detachably attached to the reservoir and communicates with the steam generator. The filter is detachably attached to the cap and extends into the reservoir. With such an arrangement, the water in the reservoir is filtered by the filter before the water is transported to the steam generator. The accumulation of impurities in the steam generator can be avoided. In addition, because the filter is attached to the cap rather than the housing, the structure of the housing and the mold to form the housing are simplified. The cost for manufacturing the steam cleaner is reduced. Furthermore, to assemble and to change the filter is easier.

Other objects, advantages and novel features of the invention will become more apparent from the following detailed description when taken in conjunction with the accompanying drawings.

DETAILED DESCRIPTION OF PREFERRED EMBODIMENT

Figure 1:
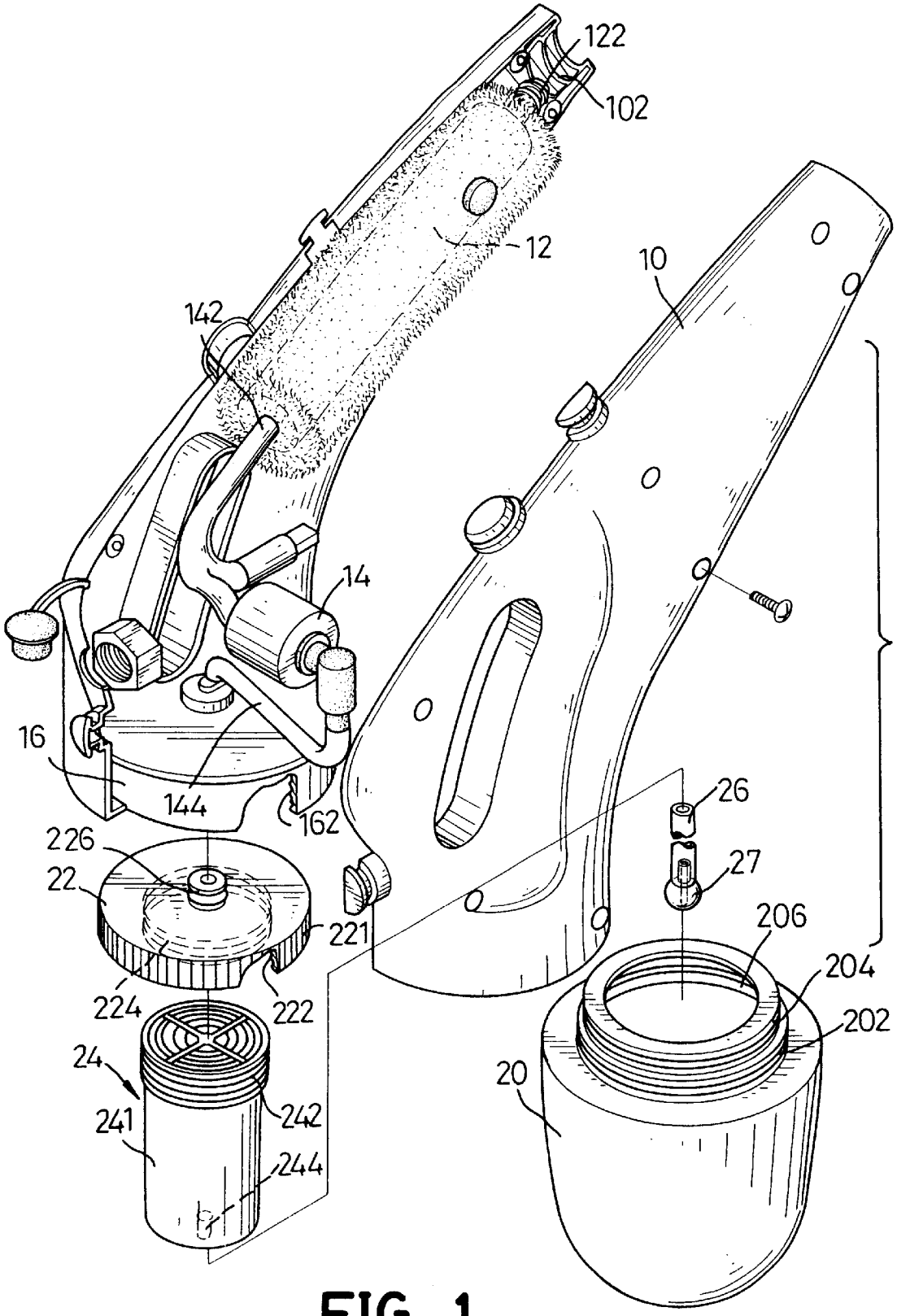
FIG. 1 is an exploded perspective view of a steam cleaner in accordance with the present invention.
Figure 2:
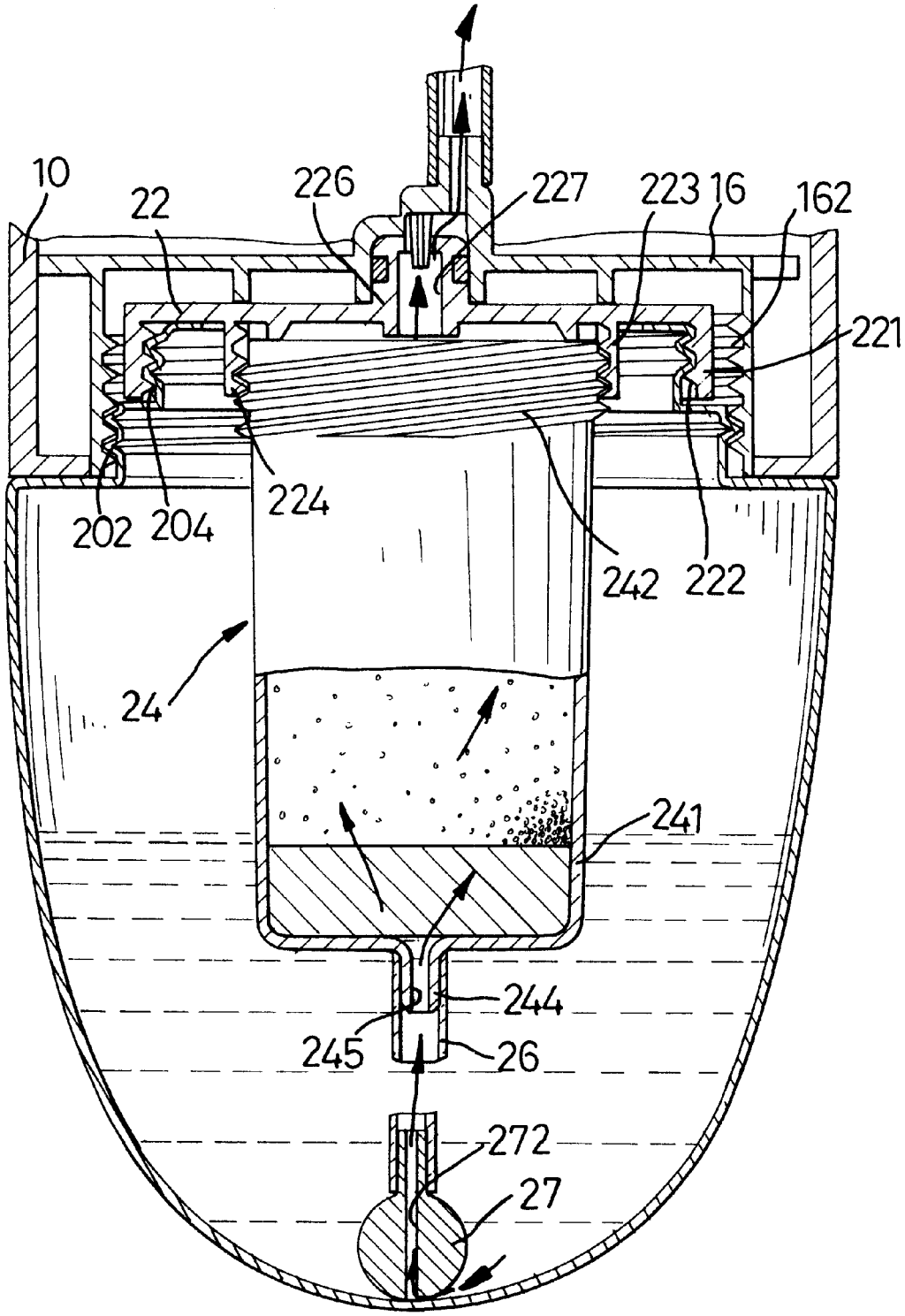
FIG. 2 is a front plan view in partial section of the reservoir of the steam cleaner in FIG. 1.
Figure 3:
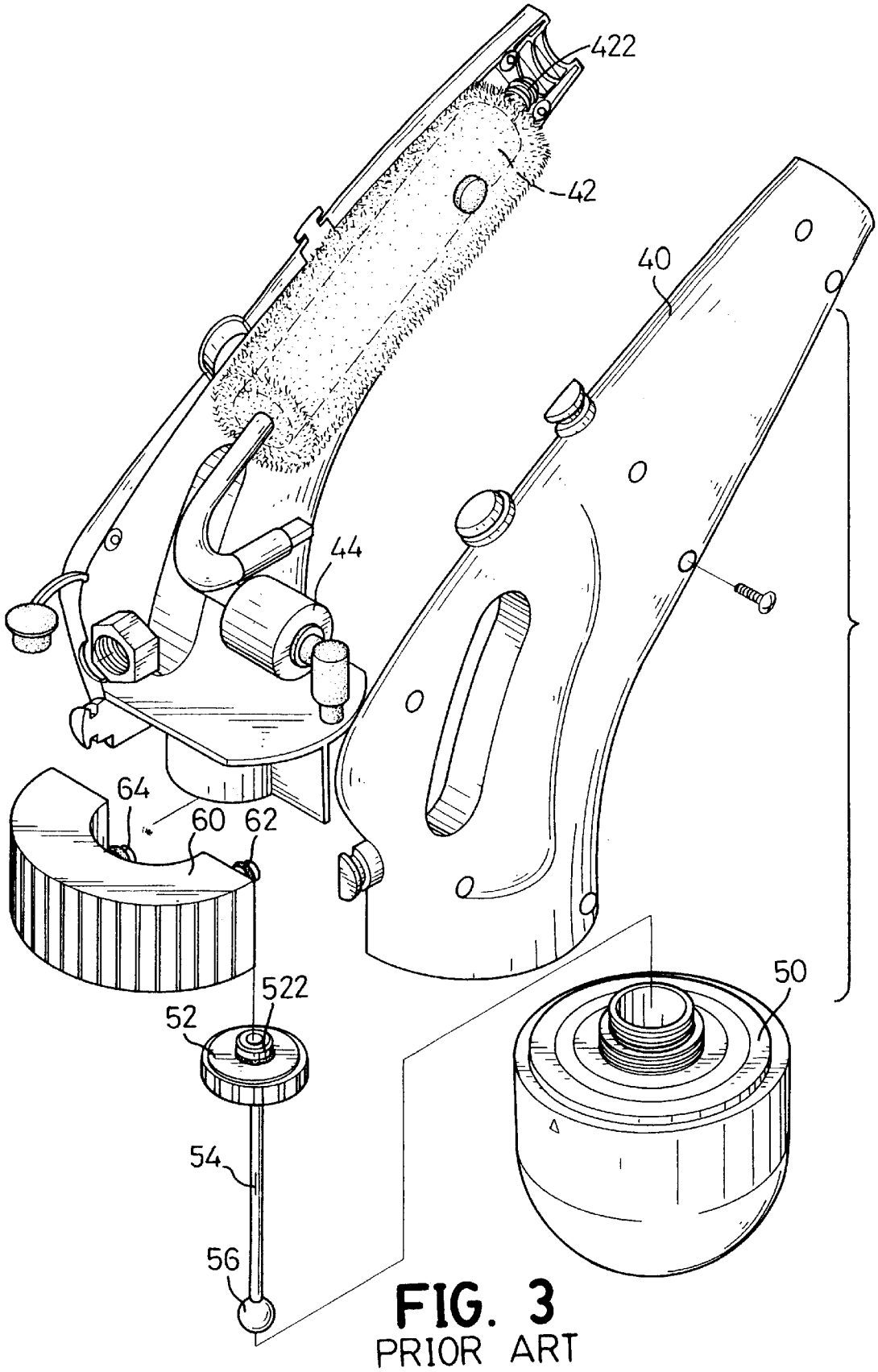
FIG. 3 PRIOR ART
FIG. 3 is an exploded perspective view of a conventional steam cleaner in accordance with the prior art.

With reference to FIGS. 1 and 2, a steam cleaner in accordance with the present invention comprises a housing (10), a steam generator (12), a pump (14), a reservoir (20), a cap (22) and a filter (24). The steam generator (12) is secured in the housing (10). A discharge opening (102) is defined in one end of the housing (10). A scrubbing element (not shown) is attached to the discharge opening (102) in the housing (10). A base (16) is formed on the other end of the housing (10) and has an inner periphery (not numbered). An inner thread (162) is formed on the inner periphery of the base (16).

The steam generator (12) is mounted in the housing (10) and has a water inlet (not numbered) and a steam outlet (not numbered). A nozzle (122) is mounted on the steam outlet of the steam generator (12) and faces the discharge opening (102) in the housing (10). The pump (14) is mounted in the housing (10) and communicates with the steam generator (12) through a discharge hose (142).

The reservoir (20) has a top (not numbered) and a bottom (not numbered), contains water and is attached to the base (16) of the housing (10). A fill opening (206) is defined in the top of the reservoir (20). A first outer thread (202) is formed on the top of the reservoir (20) to engage the inner thread (162) in the base (16). The reservoir (20) is detachably attached to the housing (10) by means of the engagement between the inner thread (162) in the base (16) and the first outer thread (202) on the reservoir (20).

A cap (22) with an exterior top and interior bottom is attached to the top of the reservoir (20) to close the fill opening (206) in the reservoir (20). A protrusion (226) with a channel (227) is formed on the top of the cap (20) to communicate with the pump (14) through a supply hose (144). An outer skirt (221) extends downward around the periphery of the cap (22). A first inner thread (222) is formed on the inner surface of the outer skirt (221). A second thread (204) is formed on the reservoir (20) to engage with the first inner thread (222) of the cap (22) so as to detachably attach the cap (22) to the reservoir (20). An inner skirt (223) extends downward from the bottom of the cap (22). A second inner thread (224) is defined in the inner surface of the inner skirt (223).

The filter (24) has a top and a bottom, is attached to the cap (22) and received in the reservoir (20). The filter (24) comprises a container (241) with at least one filter material contained in the container (241). An exterior thread (242) is formed on the periphery of the top of the container (241) to engage with the second inner thread (224) on the cap (22). The filter (24) is detachably attached to the cap (22) by means of the engagement between the second inner thread (224) and the exterior thread (242) on the container (241). Accordingly, when the cap (22) is attached to the reservoir (20), the filter (24) attached to the bottom of the cap (22) will extend into and be received in the reservoir (20).

A stub (244) with a passage (245) extends from the bottom of the container (241) of the filter (24). A pick-up hose (26) is attached to the stub (244), such that the filter (24) communicates with the reservoir (20) through the pick-up hose (26) and the passage (245) in the stub (244). A block (27) with a passage (272) is attached to the free end of the pick-up hose (26). Consequently, the free end of the pick-up hose (26) will extend near the bottom of the reservoir (20), the water near the bottom of the reservoir (20) can also be drawn into the filter (24).

In use, the water in the reservoir (20) will be pumped into the steam generator (12) by the pump (14) through the pick-up hose (26) attached to the filter (24), the filter (24), the cap (22) and the supply hose (144) communicating between the cap (22) and the pump (14). The water is heated and steam is generated. The steam is sprayed from the nozzle (122) and the discharge opening (102) in the housing (10). Consequently, when the user uses a scrubbing element to clean an object, the sprayed steam disinfects the object. In addition, because the water is filtered by the filter (24) before the water is transported to the steam generator (12), the accumulation of impurities in the steam generator (12) can be avoided. The useful life of the steam generator (12) is prolonged.

Furthermore, because the filter (24) is attached to the cap (22) rather than the housing (10), there is no need to modify the structure of the housing (10). The structure of the housing (10) and the mold to form the housing (10) are simplified. The cost for manufacturing the steam cleaner is reduced. In addition, because the filter (24) is detachably attached to the cap (22) with threads, the filter (24) is easily attached to the cap (22) and changed after an appropriate period of use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A steam cleaner comprising:

a housing having a discharge opening defined in one end of the housing;

a steam generator mounted in the housing and adapted to generate steam;

a nozzle attached to the steam generator and facing the discharge opening in the housing and adapted to spray the steam generated by the steam generator;

a pump mounted in the housing and communicating with the steam generator;

a base formed on the housing;

a reservoir detachably attached to the base and adapted to contain water in the reservoir, and having a fill opening defined in a top of the reservoir;

a cap with a top and a bottom detachably attached to the reservoir to close the fill opening in the reservoir and communicating with the pump with a supply hose; and a filter detachably attached to the cap, extending into the reservoir and communicating with the hose on the cap.

2. The steam cleaner as claimed in claim 1, wherein an outer skirt extends downward around a periphery of the cap and has an inner thread formed on an inner surface of the outer skirt; and a thread is formed on the reservoir to engage with the inner thread of the cap so as to detachably attach the cap to the reservoir.

3. The steam cleaner as claimed in claim 1, wherein the filter comprises a container with a top, a bottom and at least one filter material contained in the container.

4. The steam cleaner as claimed in claim 3, wherein an inner skirt extends downward from a bottom of the cap, an inner thread is formed on an inner periphery of the inner skirt of the cap; and a thread is formed on an outer periphery of the top of the container of the filter to engage with the inner thread on the inner skirt of the cap to detachably attach the filter to the cap.

5. The steam cleaner as claimed in claim 3, wherein a stub with a first passage extends from the bottom of the container of the filter; and a pick-up hose is attached to the stub to communicate between the reservoir and the filter through the hose and the first passage in the stub.

6. The steam cleaner as claimed in claim 5, wherein a block with a second passage extending through the block is attached to a free end of the pick-up hose to keep the free end of the pick-up hose near a bottom of the reservoir.

7. The steam cleaner as claimed in claim 1, wherein an inner thread is formed on the base; and a thread is formed on the reservoir to engage with the inner thread of the base to detachably attach the reservoir to the base.

8. The steam cleaner as claimed in claim 1, wherein a protrusion with a channel extending through the protrusion is formed on the top of the cap to communicate with the pump with the supply hose.

* * * * *